US009538853B2

(12) United States Patent
Vrzalik et al.

(10) Patent No.: US 9,538,853 B2
(45) Date of Patent: Jan. 10, 2017

(54) MULTI-LAYER SUPPORT SYSTEM

(75) Inventors: John H. Vrzalik, San Antonio, TX (US); Cesar Lina, Universal City, TX (US); Glenn C. Stroh, Marion, TX (US)

(73) Assignee: HUNTLEIGH TECHNOLOGY LIMITED, Bedfordshire (GB)

( * ) Notice: Subject to any disclaimer, the term of this patent is extended or adjusted under 35 U.S.C. 154(b) by 477 days.

(21) Appl. No.: 13/116,475

(22) Filed: May 26, 2011

(65) Prior Publication Data

US 2011/0308020 A1 Dec. 22, 2011

Related U.S. Application Data

(60) Provisional application No. 61/349,125, filed on May 27, 2010.

(51) Int. Cl.
*A61G 7/057* (2006.01)
*A47C 21/04* (2006.01)

(52) U.S. Cl.
CPC ..... *A47C 21/042* (2013.01); *A47C 21/044* (2013.01); *A61G 2007/05792* (2013.01)

(58) Field of Classification Search
CPC ..... A61G 7/057
USPC ..... 5/724–726, 714, 652.2, 423, 941
See application file for complete search history.

(56) References Cited

U.S. PATENT DOCUMENTS

| | | | | |
|---|---|---|---|---|
| 3,681,797 | A * | 8/1972 | Messner | 297/180.13 |
| 4,614,000 | A * | 9/1986 | Mayer | 5/484 |
| 5,090,074 | A * | 2/1992 | Scales et al. | 5/699 |
| 5,561,875 | A * | 10/1996 | Graebe | 5/423 |
| 5,687,438 | A * | 11/1997 | Biggie et al. | 5/654 |
| 5,926,884 | A * | 7/1999 | Biggie et al. | 5/714 |
| 7,191,482 | B2 | 3/2007 | Romano et al. | 5/713 |
| 7,914,611 | B2 | 3/2011 | Vrzalik et al. | 96/11 |
| 2006/0080778 | A1 * | 4/2006 | Chambers | 5/652.2 |
| 2007/0261548 | A1 * | 11/2007 | Vrzalik et al. | 95/52 |
| 2008/0022461 | A1 | 1/2008 | Bartlett et al. | |
| 2008/0116095 | A1 | 5/2008 | Riley et al. | |

FOREIGN PATENT DOCUMENTS

| | | | |
|---|---|---|---|
| CN | 8720181 | U | 2/1988 |
| CN | 2052230 | U | 2/1990 |
| CN | 2059059 | U | 7/1990 |
| CN | 2549831 | Y | 5/2003 |
| CN | 1893862 | A | 1/2007 |
| CN | 2936005 | Y | 8/2007 |
| CN | 201243832 | Y | 5/2009 |
| JP | 2002000403 | A | 1/2002 |

(Continued)

OTHER PUBLICATIONS

AccuMax Quantum Complete, Hill-Rom Services, Inc., copyright 2008-2012. Available online at http://www.woundsource.com/print/product/accumax-quantum-complete. Accessed Mar. 15, 2012.

(Continued)

*Primary Examiner* — Fredrick Conley
(74) *Attorney, Agent, or Firm* — Wesley Scott Ashton; Grace Doe

(57) ABSTRACT

In various embodiments, a support system includes a multi-layer support system with a number of layers. Systems and methods of removing moisture vapor from an environment surrounding patient are disclosed that accomplish such removal.

38 Claims, 5 Drawing Sheets

(56) References Cited

FOREIGN PATENT DOCUMENTS

JP 2007144007 A 6/2007

OTHER PUBLICATIONS

Gaymar SPR-Plus, Pressure Distributing Low Air Loss System, Gaymar Industries, Inc. Product Brochure. Copyright 2009. Available online at http://www.gaymar.com/wcsstore/ExtendedSitesCatalogAssetStore/pdf/SPR_Plus_New_5.pdf. Accessed Mar. 15, 2012.

PCT International Search Report and Written Opinion issued in International application No. PCT/US2011/038147, dated Oct. 5, 2011.

Span America PressureGuard Easy Air Low Air Loss Product, Span America, Product Page, Copyright 2012. Available online at http://www.spanamerica.com/easy_air.php. Accessed Mar. 15, 2012.

Reger, SI, Adams, TC, Maklebust, JA, Sahgal, V, "Validation Test for Climate Control on Air Loss Supports", Arch. Phys. Med Rehab., (2001), vol. 82, p. 597-603.

Moreno, Javier, The World Isn't Ending, Bubble Wrap is Here to Stay, BuzzFeed, Inc., 2015, at http://www.buzzfeed.com/javiermoreno/bubble-wrap-isnt-going-anywhere#.gyyroDpPY (downloaded Apr. 19, 2016).

* cited by examiner

MULTI-LAYER SUPPORT SYSTEM

CROSS REFERENCE TO RELATED APPLICATION

This application claims priority to U.S. Provisional Patent Application No. 61/349,125, filed May 27, 2010 and is incorporated by reference in its entirety.

FIELD OF THE INVENTION

The present disclosure relates generally to support surfaces for independent use and for use in association with beds and other support platforms, and more particularly but not by way of limitation to support surfaces that aid in the prevention, reduction, and/or treatment of decubitus ulcers and the transfer of moisture and/or heat from the body.

BACKGROUND

Patients and other persons restricted to bed for extended periods incur the risk of forming decubitus ulcers. Decubitus ulcers (commonly known as bed sores, pressure sores, pressure ulcers, etc.) can be formed when blood supplying the capillaries below the skin tissue is interrupted due to external pressure against the skin. This pressure can be greater than the internal blood pressure within a capillary and thus, occlude the capillary and prevent oxygen and nutrients from reaching the area of the skin in which the pressure is exerted. Moreover, moisture and heat on and around the person can exacerbate ulcers by causing skin maceration, among other associated problems.

The following are incorporated by reference: Reger S I, Adams T C, Maklebust J A, Sahgal V: Validation Test for Climate Control on Air Loss Supports; Arch. Phys. Med Rehab. 2001; 82:597-603; U.S. Patent Publication No.: US 2008/0022461 A1 (application Ser. No. 11/780,119) filed Jul. 19, 2007; U.S. Provisional Patent Application No. 61/116,095, filed Nov. 19, 2008; U.S. Provisional Patent Application No. 60/799,526, filed May 11, 2006, U.S. Provisional Patent Application No. 60/874,210, filed Dec. 11, 2006; U.S. Patent Publication No. US 2007/0261548 A1 (application Ser. No. 11/746,953), filed May 10, 2007.

SUMMARY

Exemplary embodiments of the present disclosure are directed to apparatus, systems and methods to aid in the prevention of decubitus ulcer formation and/or promote the healing of such ulcer formation. Certain exemplary embodiments comprise a multi-layer support system that can be utilized to aid in the removal of moisture, vapor, and heat adjacent and proximal the patient surface interface and in the environment surrounding the patient. Certain exemplary embodiments provide a surface that absorbs and/or disperses the moisture, vapor, and heat from the patient.

Certain exemplary embodiments comprise: a first layer comprising a vapor-permeable and liquid-impermeable material; a second layer comprising a vapor-impermeable and liquid-impermeable material; and an air mover, wherein the first layer is in partial contact with the second layer such that a plurality of channels are formed between the first layer and the second layer; and the air mover is configured to pull air through the plurality of channels formed between the first layer and the second layer and toward the air mover. In other exemplary embodiments, the second layer further comprises a cellular cushioning material. In other exemplary embodiments, the second layer further comprises a plurality of protrusions. In certain exemplary embodiments, the protrusions are encapsulated cells. In certain exemplary embodiments, the encapsulated cells are pre-filled with air. In certain exemplary embodiments, the encapsulated cells have a substantially circular cross-section. In certain exemplary embodiments, the encapsulated cells are substantially regularly-spaced.

Other exemplary embodiments comprise: a first layer comprising a vapor-permeable and liquid-impermeable material; a second layer comprising a vapor-impermeable and liquid-impermeable material; and an air mover, wherein the first layer is in partial contact with the second layer such that a plurality of channels are formed between the first layer and the second layer; and the air mover is configured to pull air through the plurality of channels formed between the first layer and the second layer and toward the air mover. In certain exemplary embodiments, the first layer comprises polyurethane. In certain exemplary embodiments, the first layer further comprises polytetrafluoroethylene. In certain exemplary embodiments, the second layer further comprises polyethylene. In certain exemplary embodiments, the thickness of the second layer is 1 inch or less. In certain exemplary embodiments, the thickness of the second layer is 0.5 inches or less. In certain exemplary embodiments, the thickness of the second layer is 0.325 inches or less. In certain exemplary embodiments, the thickness of the second layer is 0.25 inches or less. In certain exemplary embodiments, the thickness of the second layer is 0.125 inches or less.

Other exemplary embodiments comprise: a first layer comprising a vapor-permeable and liquid-impermeable material; a second layer comprising a vapor-impermeable and liquid-impermeable material; and an air mover, wherein the first layer is in partial contact with the second layer such that a plurality of channels are formed between the first layer and the second layer; and the air mover is configured to pull air through the plurality of channels formed between the first layer and the second layer and toward the air mover. In certain exemplary embodiments, the support system further comprises a coupling member configured to couple the support system to a support member. In certain embodiments, the support member is a mattress. In certain embodiments, the support member is a chair. In certain exemplary embodiments, the coupling member is selected from the group consisting of: a strap, zipper, button, buckle, and hook-and-loop fastener.

Other exemplary embodiments comprise: a first layer comprising a vapor-permeable and liquid-impermeable material; a second layer comprising a vapor-impermeable and liquid-impermeable material; and an air mover, wherein the first layer is in partial contact with the second layer such that a plurality of channels are formed between the first layer and the second layer; and the air mover is configured to pull air through the plurality of channels formed between the first layer and the second layer and toward the air mover. In certain exemplary embodiments, the air mover is integral to the first layer and the second layer. In still other embodiments, the air mover may be integral to either the first layer or the second layer. In certain exemplary embodiments, the air mover is external to the first layer and the second layer. In certain exemplary embodiments, the air mover is selected from the group consisting of a fan, a pump, and a blower, each operating either in negative or positive pressure.

Other exemplary embodiments comprise: a first layer comprising a vapor-permeable and liquid-impermeable material; a second layer comprising a vapor-impermeable and liquid-impermeable material; and an air mover, wherein the first layer is in partial contact with the second layer such that a plurality of channels are formed between the first layer and the second layer; and the air mover is configured to pull air through the plurality of channels formed between the first layer and the second layer and toward the air mover. In certain exemplary embodiments, the support system is configured so that during use: moisture vapor will transfer through the first layer into the plurality of channels; the air mover will transfer moisture vapor from a first portion of the plurality of channels to a second portion of the plurality of channels proximal to the air mover; and the air mover will transfer the moisture vapor from the second portion of the plurality of channels and into the environment outside the support system. In certain exemplary embodiments, the support system is configured to be disposed after a single use.

Other exemplary embodiments comprise a first layer comprising a vapor-permeable and liquid-impermeable material; a second layer comprising a vapor-impermeable and liquid-impermeable material; and a plurality of protrusions; wherein the first layer is in partial contact with the second layer such that a plurality of channels are formed between the first layer and the second layer. In other exemplary embodiments, the protrusions are air-filled encapsulated volumes. In other exemplary embodiments, the protrusions have a substantially circular cross-section. In other exemplary embodiments, the protrusions are regularly-spaced. In certain exemplary embodiments, the support system further comprises an air mover. In some exemplary embodiments, the support system further comprises a guard for the air mover. In certain embodiments, the air mover is configured to apply a positive pressure to the plurality of channels. In certain embodiments, the air mover is configured to apply a negative pressure to the plurality of channels.

Other exemplary embodiments comprise a first layer comprising a vapor-permeable and liquid-impermeable material; a second layer comprising a vapor-impermeable and liquid-impermeable material; and a plurality of protrusions; wherein the first layer is in partial contact with the second layer such that a plurality of channels are formed between the first layer and the second layer. In other exemplary embodiments, the first layer further comprises polyurethane. In other exemplary embodiments, the first layer further comprises polytetrafluoroethylene. In certain embodiments, the second layer has thermoplastic properties. In certain embodiments, the support system is configured to be disposed after a single use.

Other exemplary embodiments comprise a first layer comprising a vapor-permeable and liquid-impermeable material; and a second layer comprising a cellular cushioning material, the cellular cushioning material being vapor-impermeable and liquid-impermeable and having thermoplastic properties; wherein the first layer is in partial contact with the second layer such that a plurality of channels are formed between the first layer and the second layer.

Other exemplary embodiments comprise: a first layer comprising a vapor-permeable and liquid-impermeable material; a second layer comprising a vapor-impermeable and liquid-impermeable material and a plurality of protruding volumes; wherein the first layer is in partial contact with the second layer such that a plurality of channels are formed between the first layer and the second layer. In certain exemplary embodiments, the support system further comprises an air mover.

Other exemplary embodiments comprise a method of removing moisture vapor from an interface between a support system and person, the method comprising providing a support system comprising: a first layer comprising a vapor-permeable and liquid-impermeable material, a second layer comprising a vapor-impermeable and liquid-impermeable material, where the second layer is in partial contact with the first layer such that a plurality of channels are formed between the first layer and the second layer, and an air mover; transferring moisture vapor from the person, through the first layer, and into the plurality of channels between the first layer and the second layer located underneath the person; and transferring the moisture from the plurality of channels through the first layer and into the environment outside the support system.

The term "coupled" is defined as connected, although not necessarily directly, and not necessarily mechanically; two items that are "coupled" may be integral with each other. The terms "a" and "an" are defined as one or more unless this disclosure explicitly requires otherwise. The terms "substantially," "approximately," and "about" are defined as largely but not necessarily wholly what is specified, as understood by a person of ordinary skill in the art.

The terms "comprise" (and any form of comprise, such as "comprises" and "comprising"), "have" (and any form of have, such as "has" and "having"), "include" (and any form of include, such as "includes" and "including") and "contain" (and any form of contain, such as "contains" and "containing") are open-ended linking verbs. As a result, a method that "comprises," "has," "includes" or "contains" one or more steps possesses those one or more steps, but is not limited to possessing only those one or more steps. Likewise, a connector that "comprises," "has," "includes" or "contains" one or more elements possesses those one or more elements, but is not limited to possessing only those elements. For example, in a connector that comprises a nipple and a port, the connector includes the specified elements but is not limited to having only those elements. For example, such a connector could also include an annular sleeve.

The term "in partial contact" means that there is less than total contact between two surfaces. For example, a first surface is in partial with a second surface if there are portions of the first surface that do not contact or otherwise touch portions of the second surface.

Further, a device or structure that is configured in a certain way is configured in at least that way, but it can also be configured in other ways than those specifically described.

While exemplary embodiments of the present invention have been shown and described in detail below, it will be clear to the person skilled in the art that changes and modifications may be made without departing from the scope of the invention. As such, that which is set forth in the following description and accompanying drawings is offered by way of illustration only and not as a limitation. The actual scope of the invention is intended to be defined by the following claims, along with the full range of equivalents to which such claims are entitled.

In addition, one of ordinary skill in the art will appreciate upon reading and understanding this disclosure that other variations for the invention described herein can be included within the scope of the present invention. For example, some embodiments may utilize the support system in seating applications, including but not limited to, wheelchairs, chairs, recliners, benches, etc.

Figure 2:
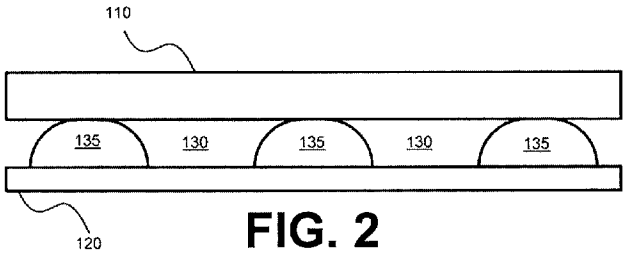
FIG. 2 illustrates a schematic side cutaway view of the embodiment of FIG. 1B.

Drawings are not to scale. Certain features may be exaggerated or not shown in order to more clearly communicate the embodiment illustrated.

DETAILED DESCRIPTION OF EXEMPLARY EMBODIMENTS

Exemplary embodiments of the present disclosure are directed to apparatuses and systems to remove moisture vapor from an interface between a support surface and a person. Certain exemplary embodiments may also be used to aid in the prevention of decubitus ulcer formation and/or promote the healing of such ulcer formation. For example, in various embodiments, preventing ulcer formation and/or healing decubitus ulcers can be accomplished through the use of a multi-layer support system. Exemplary embodiments of the multi-layer support system can be utilized to aid in the removal of moisture, vapor, and heat adjacent and proximal the patient surface interface and in the environment surrounding the patient by providing a surface that absorbs and/or disperses the moisture, vapor, and heat from the patient.

In exemplary embodiments, the multi-layer support system may include materials that provide for a low air loss feature, where one or more layers exhibit various air, vapor, and liquid permeable properties. As used herein, a low air loss feature of a multi-layer support system includes, but is not limited to: a multi-layer support system that allows air and vapor to pass through the first layer in the presence of a partial pressure difference in vapor between the internal and external environments of the multi-layer support system.

In other exemplary embodiments, the multi-layer support system can include materials that provide for substantially no air flow, where one or more layers include air impermeable properties and/or where layers are partially fastened together along the perimeter of the multi-layer coversheet. In such exemplary embodiments, this configuration may control the direction of movement of air from inside to outside (e.g., under influence by a source of positive pressure) and from outside to inside (e.g., under influence by a source of negative pressure) the multi-layer support system.

In various exemplary embodiments, systems are provided that can include a number of components that both aid in prevention of decubitus ulcer formation and to remove moisture and/or heat from the patient. For example, systems can include a multi-layer support system that can be used in conjunction with a variety of support surfaces, such as an inflatable mattress, a foam mattress, a gel mattress, a water mattress, or a RIK® Fluid Mattress of a hospital bed. In such exemplary embodiments, features of the multi-layer support system can help to remove moisture from the patient, while features of the mattress can aid in the prevention and/or healing of decubitus ulcers by further lowering interface pressures at areas of the skin in which external pressures are typically high, as for example, at bony prominences such as the heel and the hip area of the patient. In other exemplary embodiments, systems can include the multi-layer support system used in conjunction with a chair or other support platform.

In various exemplary embodiments, the support system can be a one-time use support system. As used herein, a one-time use support system is a support system for single-patient use applications that is formed of material that is disposable and/or inexpensive and/or manufactured and/or assembled in a low-cost manner and is intended to be used for a single patient over a brief period of time, such as an hour(s), a day, or multiple days.

As one of ordinary skill in the art will appreciate, vapor and air can carry organisms such as bacteria, viruses, and other potentially harmful pathogens. As such, and as will be described in more detail herein, in some embodiments of the present disclosure, one or more antimicrobial devices, agents, etc., can be provided to prevent, destroy, mitigate, repel, trap, and/or contain potentially harmful pathogenic organisms including microbial organisms such as bacteria, viruses, mold, mildew, dust mites, fungi, microbial spores, bioslimes, protozoa, protozoan cysts, and the like, and thus, remove them from air and from vapor that is dispersed and removed from the patient and from the environment surrounding the patient. In addition, in various embodiments, support system can include various layers having antimicrobial activity. In some embodiments, for example, first and second layers can include particles, fibers, threads, etc., formed of silver and/or other antimicrobial agents. Other antimicrobial devices and agents are also contemplated.

Figure 3:
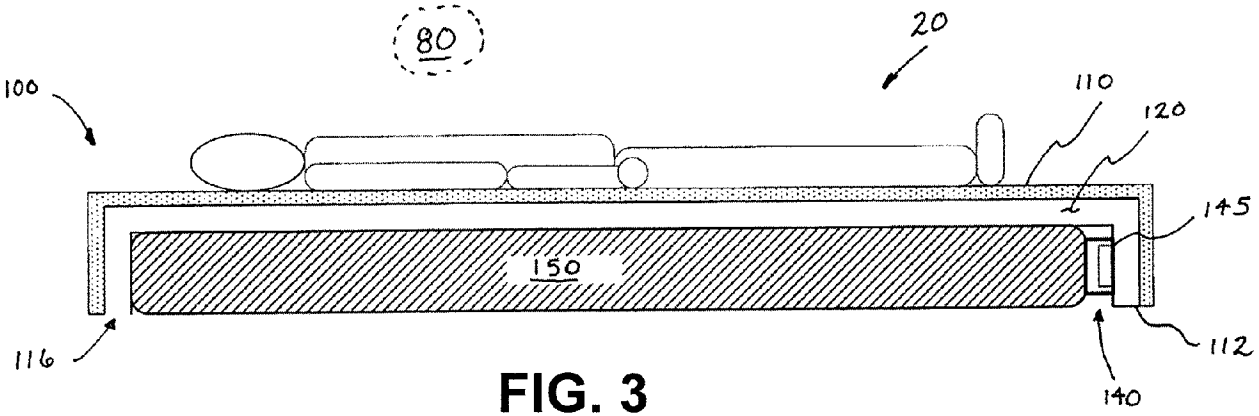
FIG. 3 illustrates a section view of the embodiment of FIG. 1 with a patient being supported by the support system.

Referring initially to FIGS. 1-3, a support system 100 is shown coupled to a mattress 150. In this embodiment, support system 100 is configured to extend around the sides of mattress 150 and to the lower surface of mattress 150. Mattress 150 can be any configuration known in the art for supporting a person. For example, in certain exemplary embodiments, mattress 150 may be an alternating-pressure-pad-type mattress or other type of mattress using air to inflate or pressurize a cell or chamber within the mattress. In other exemplary embodiments, mattress 150 does not utilize air to support a person. In some embodiments support system 100 may be used in seating applications, including but not limited to, wheelchairs, chairs, recliners, benches, etc.

Figure 1A:
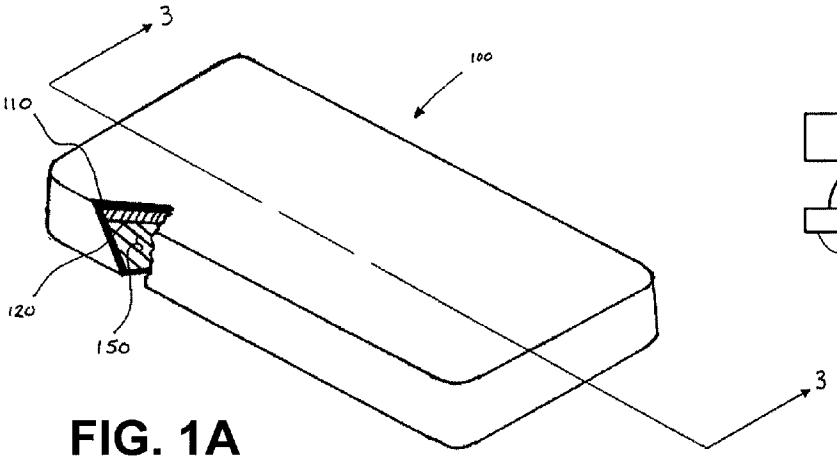
FIG. 1A illustrates a schematic perspective view of one embodiment of a support structure.
Figure 1B:
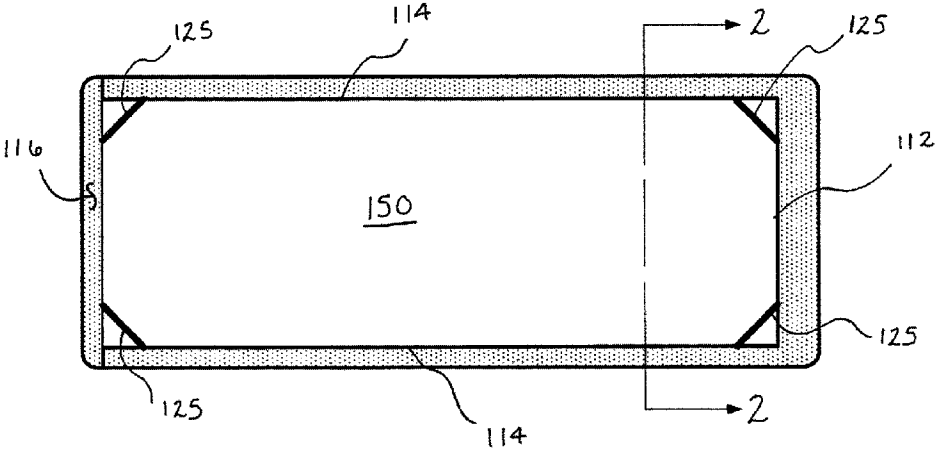
FIG. 1B illustrates the underside view of a support structure coupled to a mattress.

FIG. 1A discloses a partial section perspective view of a support system 100 mounted on a mattress 150. Support system 100 comprises first layer 110 and second layer 120. In FIG. 1A, support system 100 is shown coupled to mattress 150. FIG. 1B depicts the underside of mattress 150 coupled to support system 100. In certain embodiments, support system 100 may be coupled to mattress 150 via a coupling member 125, as shown in FIG. 1B. In certain embodiments, coupling member 125 may comprise elastic. In other embodiments, coupling member 125 may comprise a hook-and-loop fastener, buttons, snaps, straps, zippers, or other suitable coupling devices. In other embodiments, support system 100 may be coupled to mattress 150 by tucking material (e.g. a first layer 110 and/or a second layer 120) from support system 100 under mattress 150. In embodiments where support system 100 is used in seating applications, coupling member 125 may be used to couple support system 100 to the seat (not pictured).

As shown in FIG. 1B, in some embodiments, first layer 110 and second layer 120 are joined at sealed end 112 and sealed sides 114 to form an airtight seal. Sealed end 112 and sealed sides 114 may be stitched, glued, epoxied, welded, radio-frequency welded, or otherwise joined such that an airtight or substantially airtight seal is formed. In some embodiments, first layer 110 and second layer 120 are not joined along one edge, forming opening 116. In other embodiments, first layer 110 and 120 are joined by a vent material that allows for the ready passage of air and moisture vapor through opening 116. In still other embodiments, opening 116 could comprise a valve, a slit, or a hole through which air and moisture vapor may pass.

FIG. 2 is a cross-sectional view of support system 100 taken along section line 2-2 in FIG. 1B showing channels 130 formed between first layer 110 and second layer 120. As shown in FIG. 2, second layer 120 is in partial contact with first layer 110 such that a plurality of channels 130 are formed between first layer 110 and second layer 120. In exemplary embodiments, having second layer 120 in partial contact with first layer 110 allows air to flow through channels 130 when a person is laying on the material while the material is supported by a mattress.

In certain embodiments, second layer 120 comprises a plurality of protrusions 135. In certain embodiments, second layer 120 may comprise a cellular cushioning material. In particular embodiments, second layer 120 may comprise a plastic sheet material. In certain embodiments, the plastic sheet material may comprise polyethylene. In some embodiments, protrusions 135 are encapsulated cells or volumes. In specific embodiments, the encapsulated cells or volumes are regularly spaced. The encapsulated cells or volumes may contain a volume of air in some embodiments. The encapsulated cells or volumes may, in some embodiments, have a substantially circular cross-section. In some embodiments, each of the encapsulated cells or volumes may be filled with air. In other embodiments, most of the encapsulated cells or volumes may be filled with air. A specific example of a material that may be used for second layer 120 is sold under the trade name Bubble Wrap®. Other similar products may be used.

FIG. 3 discloses a cross-sectional view of support system 100 and mattress 150 taken along section line 3-3 in FIG. 1A. As shown in this exemplary embodiment, support system 100 comprises first layer 110, second layer 120, and air mover 140. In this embodiment, support system 100 is configured so that first layer 110 is the layer that will contact a patient 20 that is supported by support system 100. Support system 100 is further configured such that second layer 120 is between first layer 110 and mattress 150.

In this exemplary embodiment, first layer 110 comprises a material that is vapor permeable and liquid impermeable. First layer 110 may be air permeable or air impermeable. An example of a material that is vapor permeable, liquid impermeable, and air impermeable is a hospital bedsheet comprising polyurethane. An example of a material that is vapor permeable, liquid impermeable, and air permeable is a hospital bedsheet comprising polytetrafluoroethylene. Here, second layer 120 comprises a material that is vapor impermeable, liquid impermeable and air impermeable.

In the illustrated exemplary embodiment, air mover 140 is located between second layer 120 and mattress 150. Air mover 140 is in fluid communication with channels 130 between first layer 110 and second layer 120. In certain exemplary embodiments, air mover 140 may comprise a guard 145 or other partition to prevent material from blocking the inlet or outlet of air mover 140. In the illustrated embodiment, air mover 140 is located on the same side of support system 100 as sealed end 112 and opposite opening 116. In some embodiments, air mover 140 is configured to pull air into opening 116 through channels 130 toward air mover 140 by applying a negative pressure to channels 130.

In one embodiment, air mover 140 is a 12 volt DC fan such as an ACT-RX Technology Corporation CeraDyna Fan (Model 5115). This particular air mover is 5.1 cm wide by 5.1 cm tall by 1.5 cm thick and weighs approximately 25 grams. This air mover produces an air flow of about 4.10 cfm (0.12 cmm), a maximum air pressure of 16.08 mm-$H_2O$ and an acoustical noise rating of 37.5 dB(A). The CeraDyna Fan is a centrifugal fan that is configured to intake air perpendicular to the axis of rotation of the blades and exhaust air tangentially to the axis of rotation of the blades.

By using an air mover such as the CeraDyna Fan or other similarly-sized devices, air mover 140 can be placed integral to first layer 110 and second layer 120, allowing for a more compact overall design of support system 100. In certain embodiments, air mover 140 may be coupled to first layer 110 and second layer 120 with a substantially airtight seal so that air does not flow around air mover 140. Air mover 140 may be coupled through first layer 110 and/or second layer 120 in various embodiments.

In other embodiments, air mover 140 may be coupled to first layer 110 such that air mover 140 is outside (or "on top of" or "on the patient side") of support system 100. In still other embodiments, air mover 140 may be coupled to second layer 120 such that air mover 140 is inside (or "under" or "on the mattress side") of support system 100. Placing air mover 140 in a location that is not between support mattress 150 and the patient will not adversely affect the patient's comfort. In other embodiments where air mover 140 is sufficiently small, air mover 140 may be placed between the patient and mattress 150 without adversely affecting the patient's comfort.

In other exemplary embodiments, air mover 140 may be external to first layer 110 and second layer 120 with appropriate connecting members such as tubing, piping or duct work, etc. In such embodiments, air mover 140 is in fluid communication with channels 130. For example, air mover 140 may be a pump coupled to first layer 110 and second layer 120 with tubing and a valve.

In other exemplary embodiments, air mover 140 may be configured to apply a positive pressure to channels 130. Air mover 140 may be configured to intake ambient air and blow the ambient air through channels 130 away from air mover 140 and toward opening 116. Negative pressure air movers and positive pressure air movers are discussed in more detail below.

Figure 4A:
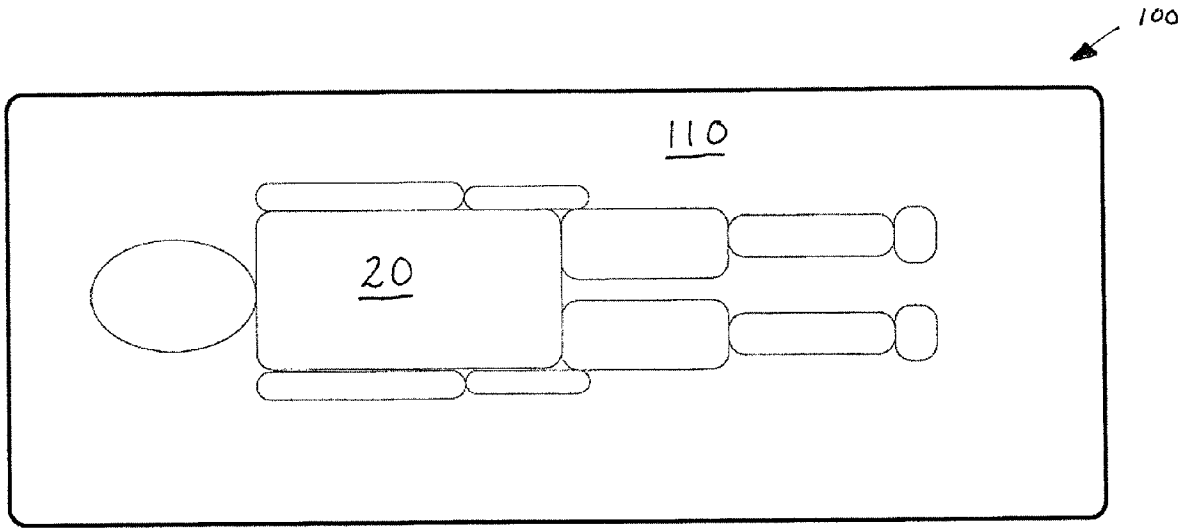
FIG. 4A illustrates a patient being supported by the support system.

Turning now to FIG. 4A, patient 20 is shown laying on first layer 110 of support system 100. As discussed above, when patient 20 lays on support system 100 for an extended period of time, moisture in the form of perspiration accumulates between patient 20 and first layer 110. The amount of accumulated moisture may be expressed in terms of relative humidity (%). Relative humidity is a term used to describe the amount of water vapor that exists in a gaseous mixture of air and water vapor, compared to the upper limit of what it could be at the same temperature and bulk pressure.

Figure 4B:
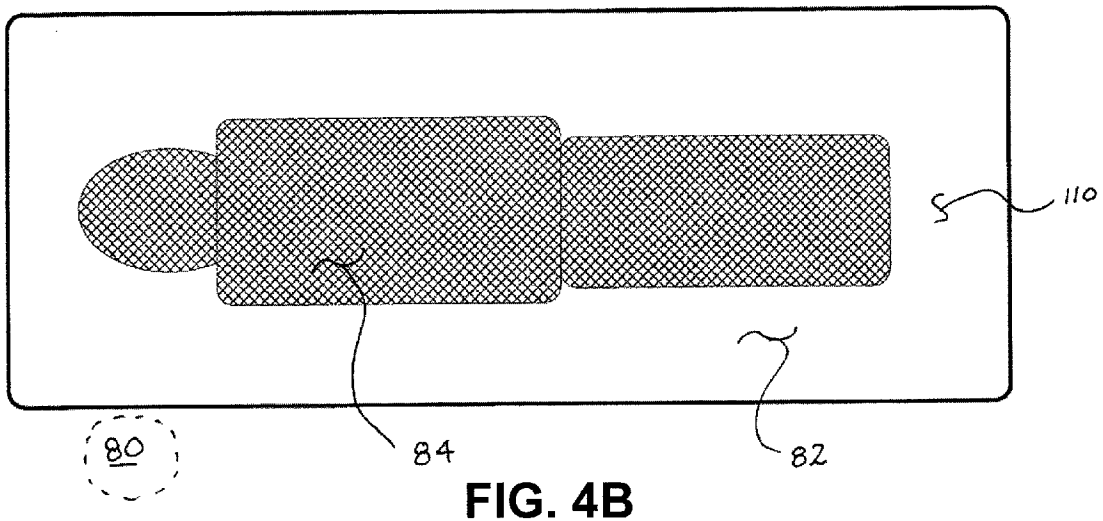
FIG. 4B illustrates zones of higher and lower relative humidity.

FIG. 4B depicts regions of varying relative humidity. Patient 20 laying on support system 100 leaves a patient footprint 84 on support system 100. Patient footprint 84 represents the portion of support system 100 where the relative humidity is greatest. When patient 20 perspires, patient footprint 84 is created on first layer 110 under patient 20 where the relative humidity exceeds the relative humidity of ambient air 80. Ambient air 80 is the air surrounding patient 20, e.g. the air in the hospital room. Intermediate zone 82 is the portion of first layer 110 whose microclimate is minimally influenced by patient perspiration. Generally, intermediate zone 82 is the area of first layer 110 that is not substantially beneath patient 20.

An illustrative example will now be discussed. The percent relative humidity values given are for illustrative purposes only; one skilled in the art will understand that the relative humidity values in each region will vary from patient to patient and from ambient environment to ambient environment. In this example, patient 20 is perspiring, which causes the relative humidity of the air between patient 20 and first layer 110 to be 100%. That is, the amount of water vapor in the gaseous mixture of air and water vapor under the patient is at its upper limit for that temperature and pressure. At patient footprint 84, the relative humidity between patient 20 and first layer 110 is 100%. The relative humidity in channels 130 between first layer 110 and second layer 120 is 70%. At intermediate zone 82, the relative humidity in channels 130 between first layer 110 and second layer 120 is 70%, while the relative humidity of ambient air 80 is 50%.

Moisture vapor travels from zones of high relative humidity to zones of low relative humidity to seek equilibrium. Therefore, moisture vapor between patient 20 and first layer 110 corresponding to patient footprint 84 having a relative humidity of 100% will travel through vapor-permeable first layer 110 to channels 130, where the relative humidity is lower at 70%. In intermediate zone 82 however, the area of lower relative humidity is outside channels 130; therefore, moisture vapor in channels 130 at 70% RH will travel through first layer 110 to ambient air 80 at 50% RH.

Removing moisture vapor from channels 130 beneath patient 20 is crucial to preventing various ailments, e.g. decubitus ulcers. Moisture vapor may be removed from channels 130 by applying a negative pressure or a positive pressure to channels 130 and inducing an air flow within the channels that moves the air and moisture vapor toward an opening, out of channels 130, and into the ambient environment.

Figure 5:
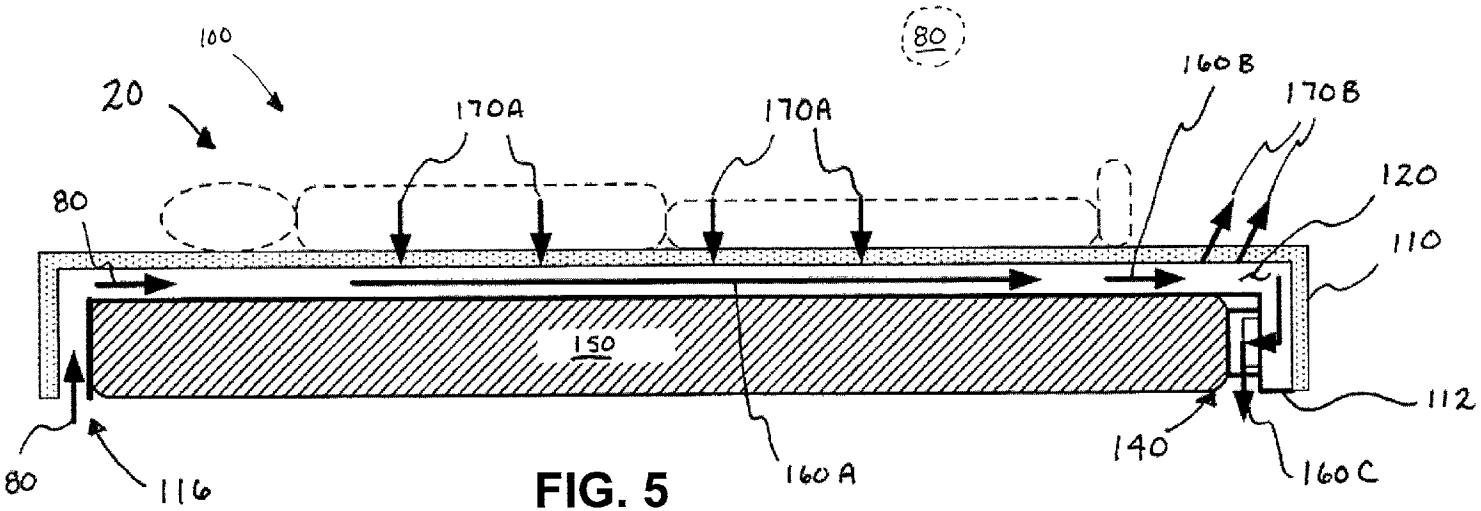
FIG. 5 illustrates a schematic side cutaway view of one embodiment of a support structure having a first layer that is air impermeable, vapor permeable, and liquid impermeable.

Turning now to FIG. 5, an embodiment of support system 100 is presented. In this embodiment, air mover 140 creates a suction air flow in channels 130 between first layer 110 and second layer 120. In this embodiment, first layer 110 is vapor permeable, liquid impermeable, and air impermeable.

Air mover 140 applies negative pressure to channels 130, creating a suction flow. The negative pressure causes ambient air 80 (at e.g., 50% RH) to be drawn into opening 116. Patient 20 perspires, creating moisture vapor 170A (at e.g., 100% RH) between patient 20 and first layer 110. Seeking a zone of lower relative humidity, moisture vapor 170A passes through first layer 110 into channels 130 where the relative humidity is lower than 100%. As it is drawn toward air mover 140, ambient air 80 enters channels 130 beneath patient footprint 84. Ambient air 80 combines with moisture vapor 170A to form channel air 160A having a relative humidity greater than that of ambient air 80 but less than that of moisture vapor 170A (e.g., 70% RH).

As channel air 160A continues toward air mover 140, channel air 160A leaves patient footprint 84 and enters intermediate zone 82. In intermediate zone 82, channel air 160A has a higher relative humidity (e.g. 70%) than ambient air 80. The relative humidity in channels 130 beneath intermediate zone 82 will vary depending on the distance from patient 20, the size of patient footprint 84, and the amount patient 20 perspires, but in general, the relative humidity in channels 130 under intermediate zone 82 decreases as distance from patient 20 increases. Seeking an area of lower relative humidity, some moisture vapor 170B passes through vapor-permeable first layer 110. Because first layer 110 is air-impermeable in this embodiment, air cannot pass through first layer 110. Removing moisture vapor 170B from channel air 160A results in diluted channel air 160B, which has a relative humidity lower than that of channel air 160A (e.g. 65%). Diluted channel air 160B continues to be drawn through channels 130 toward air mover 140.

In this embodiment, air mover 140 is a centrifugal fan. In contrast to a typical fan, which moves air parallel to the axis about which the fan blades rotate, a centrifugal fan moves air perpendicular to the axis of rotation. Thus, air mover 140 pulls diluted channel air 160B toward and through itself, expelling diluted channel air 160B as exhaust air 160C. Exhaust air 160C is forced out into the ambient environment, where it dilutes to ambient air 80.

Figure 6:
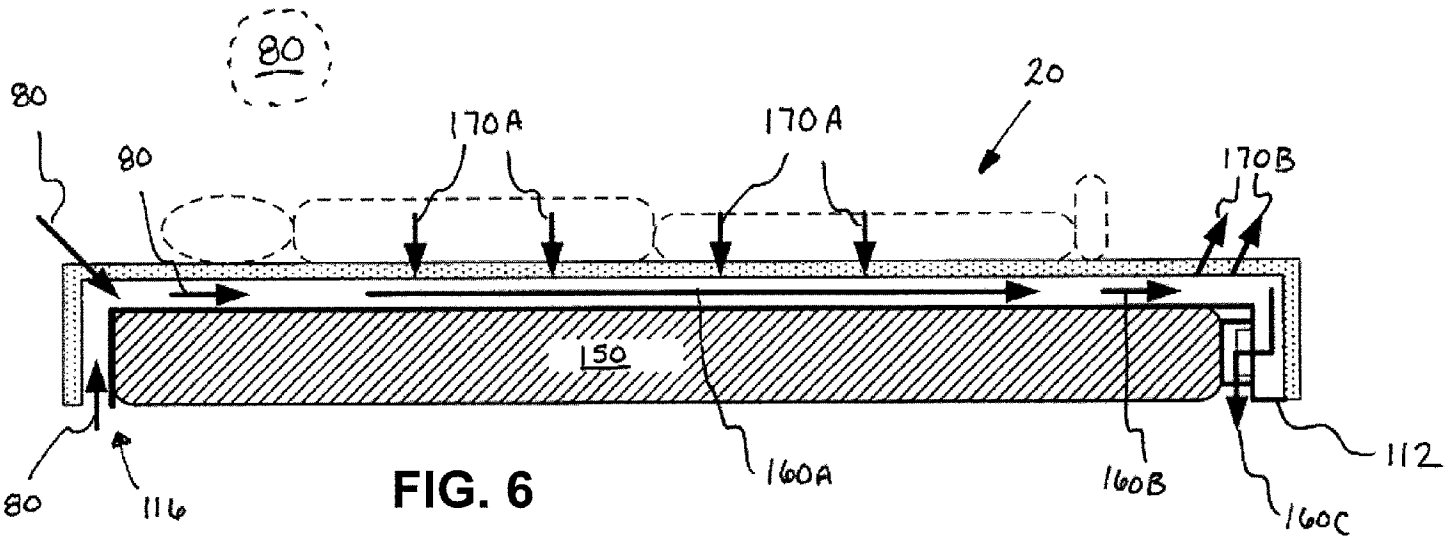
FIG. 6 illustrates a schematic side cutaway view of one embodiment of a support structure having a first layer that is air permeable, vapor permeable, and liquid impermeable.

Turning now to FIG. 6, an embodiment of support system 100 similar to that of FIG. 5 is shown, except that in this embodiment, first layer 110 is vapor permeable and air permeable. Water vapor and air may pass through first layer 110, but liquid may not.

Air mover 140 applies negative pressure to channels 130, creating a suction flow. The negative pressure causes ambient air 80 (at e.g., 50% RH) to be drawn into opening 116. Because first layer 110 is air permeable in this embodiment, some ambient air 80 may pass through first layer 110 in intermediate zone 82. Patient 20 perspires, creating moisture vapor 170A (at e.g., 100% RH) between patient 20 and first layer 110. Seeking a zone of lower relative humidity, moisture vapor 170A passes through first layer 110 into channels 130 where the relative humidity is lower than 100%. As it is drawn toward air mover 140, ambient air 80 enters channels 130 beneath patient footprint 84. Ambient air 80 combines with moisture vapor 170A to form channel air 160A having a relative humidity greater than that of ambient air 80 but less than that of moisture vapor 170A (e.g., 70% RH).

As channel air 160A continues toward air mover 140, channel air 160A leaves patient footprint 84 and enters intermediate zone 82. The relative humidity in channels 130 beneath intermediate zone 82 will vary depending on the distance from patient 20, the size of patient footprint 84, and the amount patient 20 perspires, but in general, the relative humidity in channels 130 under intermediate zone 82 decreases as distance from patient 20 increases. In intermediate zone 82, channel air 160A has a higher relative humidity (e.g. 70%) than ambient air 80. Seeking an area of lower relative humidity, some moisture vapor 170B passes through vapor-permeable first layer 110. Because first layer 110 is air-impermeable in this embodiment, air cannot pass through first layer 110. Removing moisture vapor 170B from channel air 160A results in diluted channel air 160B, which has a relative humidity lower than that of channel air 160A (e.g. 65%). Diluted channel air 160B continues to be drawn through channels 130 toward air mover 140. air mover 140 pulls diluted channel air 160B toward and through itself, expelling diluted channel air 160B as exhaust air 160C. Exhaust air 160C is forced out into the ambient environment, where it dilutes to ambient air 80.

Figure 7:
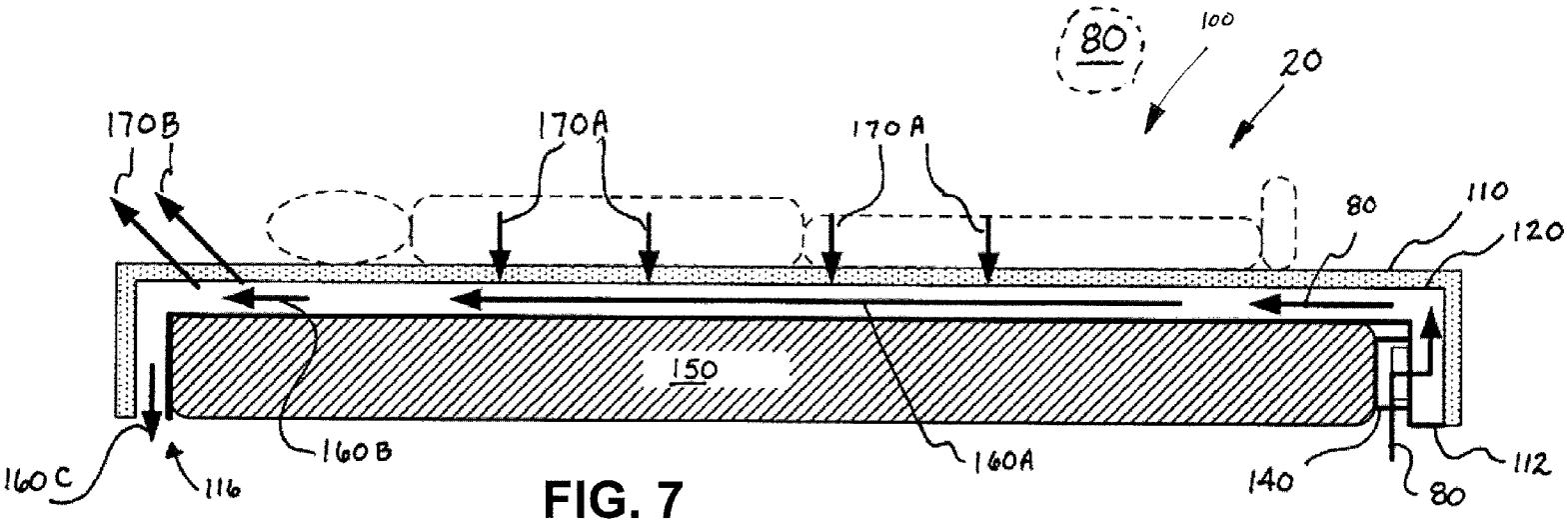
FIG. 7 illustrates a schematic side cutaway view of one embodiment of a support structure having a first layer that is air impermeable, vapor permeable, and liquid impermeable.
Figure 8:
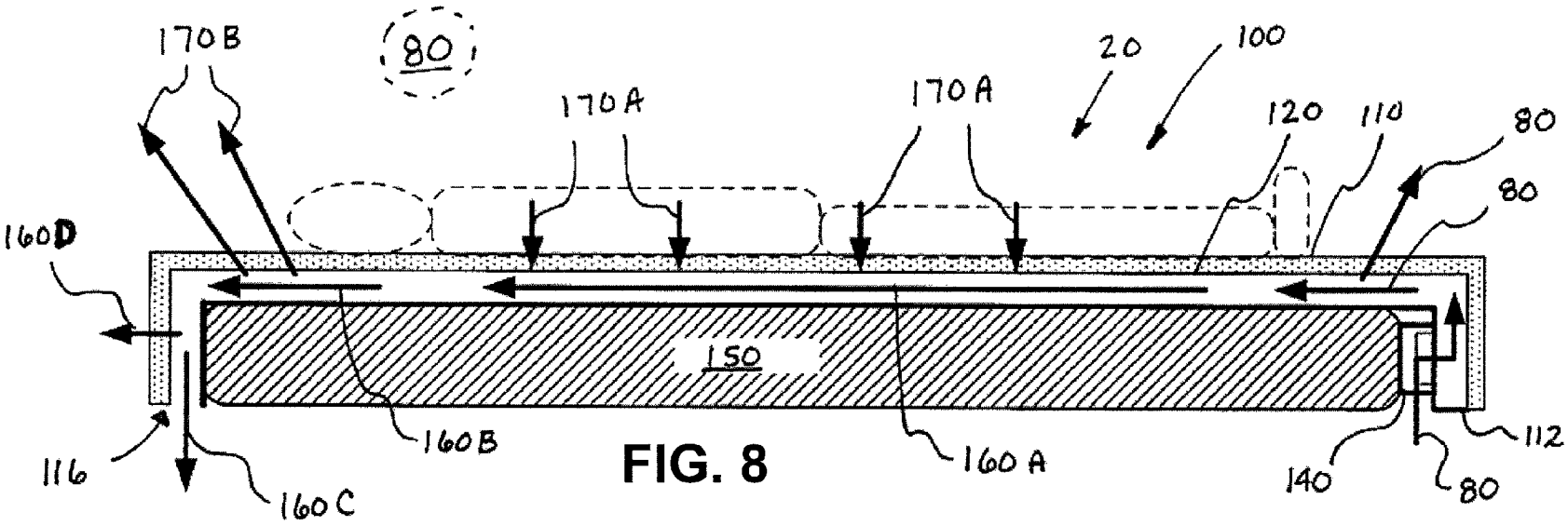
FIG. 8 illustrates a schematic side cutaway view of one embodiment of a support structure having a first layer that is air permeable, vapor permeable, and liquid impermeable.

In other embodiments, such as those pictured in FIGS. 7 and 8, air mover 140 is configured to apply positive pressure to channels 130. The embodiment depicted in FIG. 7 is similar to the embodiment depicted in FIG. 5, except that in FIG. 7, air mover 140 provides positive air pressure to channels 130 to direct ambient air 80 from the outside environment into channels 130. The pressure is positive in the sense that the pressure in the channels is greater than the pressure in the surrounding environment.

Air mover 140 is configured to draw ambient air 80 from the surrounding environment, through air mover 140, and into channels 130. Air mover 140 applies positive pressure to channels 130, creating a pressure flow. Because the gaseous mixture in channels 130 cannot flow through sealed end 112 or sealed sides 114, it is forced through channels 130 to opening 116.

In the embodiment shown in FIG. 7, first layer 110 is vapor permeable, air impermeable, and liquid impermeable. Patient 20 perspires, creating moisture vapor 170A (at e.g., 100% RH) between patient 20 and first layer 110. Seeking a zone of lower relative humidity, moisture vapor 170A passes through first layer 110 into channels 130 where the relative humidity is lower than 100%. As it is blown away from air mover 140, ambient air 80 passes from channels beneath intermediate zone 82 to channels 130 beneath patient footprint 84. Ambient air 80 combines with moisture vapor 170A to form channel air 160A having a relative humidity greater than that of ambient air 80 but less than that of moisture vapor 170A (e.g., 70% RH).

As channel air 160A moves away from air mover 140, channel air 160A leaves channels 130 beneath patient footprint 84 and enters channels 130 beneath intermediate zone 82. In channels 130 beneath intermediate zone 82, channel air 160A has a higher relative humidity (e.g. 70%) than ambient air 80. The relative humidity in channels 130 beneath intermediate zone 82 will vary depending on the distance from patient 20, the size of patient footprint 84, and the amount patient 20 perspires, but in general, the relative humidity in channels 130 under intermediate zone 82 decreases as distance from patient 20 increases. Seeking an area of lower relative humidity, some moisture vapor 170B passes through vapor-permeable first layer 110. Because first layer 110 is air-impermeable in this embodiment, air cannot pass through first layer 110. Removing moisture vapor 170B from channel air 160A results in diluted channel air 160B, which has a relative humidity lower than that of channel air 160A (e.g. 65%). Diluted channel air 160B continues to be blown away from air mover 140 toward opening 116. Channel air 160B exits opening 116 as exhaust air 160C. Exhaust air 160C is forced out into the ambient environment, where it dilutes to ambient air 80.

Turning now to the embodiment shown in FIG. 8, a support system 100 is shown that is similar to the embodiment shown in FIG. 6, except that here, air mover 140 is configured to apply a positive pressure in channels 130. In the embodiment shown in FIG. 8, the first layer is vapor permeable, air permeable, and liquid impermeable.

Air mover 140 is configured to draw ambient air 80 through air mover 140 and into channels 130. Air mover 140 applies positive pressure to channels 130, creating a pressure flow. The positive pressure causes ambient air 80 (at e.g., 50% RH) to be forced through channels 130 toward opening 116. Pressure in channels 130 is greater than pressure in the ambient environment. Because of the difference in pressure and the air-permeability of first layer 110, some ambient air 80 may be forced out of channels 130 in intermediate zone 82 through first layer 110 and into the ambient environment before reaching patient 20.

Patient 20 perspires, creating moisture vapor 170A (at e.g., 100% RH) between patient 20 and first layer 110. Seeking a zone of lower relative humidity, moisture vapor 170A passes through first layer 110 into channels 130 where the relative humidity is lower than 100%. As it is pushed away from air mover 140 toward opening 116, ambient air 80 enters channels 130 beneath patient footprint 84. Ambient air 80 combines with moisture vapor 170A to form channel air 160A having a relative humidity greater than that of ambient air 80 but less than that of moisture vapor 170A (e.g., 70% RH).

As channel air 160A continues toward opening 116, channel air 160A leaves channels 130 beneath patient footprint 84 and enters channels 130 beneath intermediate zone 82. The relative humidity in channels 130 beneath intermediate zone 82 will vary depending on the distance from patient 20, the size of patient footprint 84, and the amount patient 20 perspires, but in general, the relative humidity in channels 130 under intermediate zone 82 decreases as distance from patient 20 increases. In intermediate zone 82, channel air 160A has a higher relative humidity (e.g. 70%) than ambient air 80. Seeking an area of lower relative humidity, some moisture vapor 170B passes through vapor-permeable first layer 110. Removing moisture vapor 170B from channel air 160A results in diluted channel air 160B, which has a relative humidity lower than that of channel air 160A (e.g. 65%). Diluted channel air 160B continues to be pushed through channels 130 toward opening 116. Owing to the greater pressure in channels 130 than in the surrounding environment, some diluted channel air 160B air may escape channels 130 through air-permeable first layer 110 as escape air 160D, where it dilutes to ambient air 80. The remaining diluted channel air 160B exits opening 116 as exhaust air 160C. Exhaust air 160C is forced out into the ambient environment, where it dilutes to ambient air 80.

The invention claimed is:

1. A support system comprising:

a first layer comprising a material that allows moisture to pass through the first layer while substantially preventing air from passing through the first layer;

a second layer secured to the first layer so as to form an airtight seal at sides and one end and so as to form an opening at another end opposite the one end, wherein the second layer comprises a base layer; and a plurality of protrusions disposed on the base layer and extend towards the first layer, wherein the protrusions comprise a plurality of permanently air-filled, substantially airtight, independent, encapsulated cells, wherein the first layer is in partial contact with the protrusions such that the protrusions form a plurality of channels between the first layer and the second layer; and an air mover, wherein the air mover is configured to pull air through the opening and through the plurality of channels formed between the first layer and the second layer and toward the air mover, or the air mover is configured to push air away from the air mover and through the plurality of channels formed between the first layer and the second layer and through the opening.

2. The support system of claim 1, where the second layer comprises a cellular cushioning material.

3. The support system of claim 1, where the encapsulated cells comprise a plurality of protrusions.

4. The support system of claim 1, wherein the second layer comprises a vapor impermeable and liquid impermeable material.

5. The device of claim 1, wherein the airflow of the air mover is about 4 CFM.

6. The support system of claim 1, wherein the encapsulated cells have a substantially circular cross-section.

7. The support system of claim 1, where the encapsulated cells are substantially regularly-spaced.

8. The support system of claim 1, where the first layer further comprises polytetrafluoroethylene.

9. The support system of claim 1, where the first layer further comprises polyurethane.

10. The support system of claim 1, where the second layer further comprises polyethylene.

11. The support system of claim 1 wherein the support system is configured to be disposed after a single use.

12. The support system of claim 1, where the thickness of the second layer is 0.5 inches or less.

13. The support system of claim 1, where the thickness of the second layer is 0.375 inches or less.

14. The support system of claim 1, where the thickness of the second layer is 0.25 inches or less.

15. The support system of claim 1, further comprising a coupling member configured to couple the support system to a support member.

16. The support system of claim 15, where the support member is a mattress.

17. The support system of claim 15, where the support member is a chair cushion.

18. The support system of claim 15, where the support member is a chair.

19. The support system of claim 15, wherein the coupling member is selected from the group consisting of: a strap, zipper, button, buckle, and hook-and-loop fastener.

20. The support system of claim 1, where the air mover is integral to the first layer and the second layer.

21. The support system of claim 1, where the air mover is integral to either the first layer or the second layer and is in fluid communication with the plurality of channels.

22. The support system of claim 1, where the air mover is external to the first layer and the second layer.

23. The support system of claim 1, where the air mover is selected from the group consisting of a fan, a pump, and a blower.

24. The support system of claim 1 wherein the support system is configured so that during use:

moisture vapor will transfer through the first layer into the plurality of channels;

the air mover will transfer moisture vapor from a first portion of the plurality of channels to a second portion of the plurality of channels proximal to the air mover; and the air mover will transfer the moisture vapor from the second portion of the plurality of channels and into the environment outside the support system.

25. A support system comprising:

a first layer comprising a vapor-permeable, liquid-impermeable, substantially air impermeable material for allowing moisture to pass through said first layer while substantially preventing air from passing through said first layer; and a second layer comprising a cellular cushioning material, the cellular cushioning material comprising a plurality of encapsulated, independent, permanently air-filled volumes, and being vapor-impermeable and liquid-impermeable and having thermoplastic properties;

wherein the first layer is in partial contact with tops of the encapsulated, air-filled volumes of the second layer and forms an airtight seal with the second layer such that the encapsulated, air-filled volumes define a plurality of channels between the first layer and the second layer; and an air mover for circulating air through the plurality of channels.

26. The device of claim 25, wherein the airflow of the air mover is about 4 CFM.

27. A support system comprising:

a first layer comprising a vapor-permeable, liquid-impermeable, substantially air impermeable material for allowing moisture to pass through said first layer while substantially preventing air from passing through said first layer;

a second layer comprising:

a vapor-impermeable and liquid-impermeable material; and a plurality of protrusions forming a plurality of permanently air-filled, substantially airtight, independent, encapsulated cells;

wherein the first layer is in partial contact with the second layer such that the encapsulated cells define a plurality of channels between the first layer and the second layer; and an air mover for moving air through the plurality of channels, wherein the support system is configured to be coupled to a mattress.

28. The support system of claim 27, wherein the protrusions have a substantially circular cross-section.

29. The support system of claim 27, wherein the protrusions are regularly-spaced.

30. The support system of claim 29, wherein the protrusions have a substantially circular cross-section.

31. The device of claim 27, wherein the airflow of the air mover is about 4 CFM.

32. The support system of claim 27, further comprising a guard for the air mover.

33. The support system of claim 27, where the air mover is configured to apply a negative pressure to the plurality of channels.

34. The support system of claim 27, where the air mover is configured to apply a positive pressure to the plurality of channels.

35. The support system of claim 27, where the first layer further comprises polytetrafluoroethylene.

36. The support system of claim 27, where the first layer further comprises polyurethane.

37. The support system of claim 27, wherein the second layer has thermoplastic properties.

38. The support system of claim 27 wherein the support system is configured to be disposed after a single use.

* * * * *